US009650731B2

(12) United States Patent
Capparelli Mattoso et al.

(10) Patent No.: US 9,650,731 B2
(45) Date of Patent: May 16, 2017

(54) METHOD AND APPARATUS TO PRODUCE MICRO AND/OR NANOFIBER WEBS FROM POLYMERS, USES THEREOF AND COATING METHOD

(75) Inventors: Luiz Henrique Capparelli Mattoso, Sao Carlos (BR); Eliton Souto De Medeiros, Sao Carlos (BR)

(73) Assignee: EMPRESA BRASILEIRA DE PESQUISA AGROPECUARIA—EMBRAPA, Brasilia (BR)

( * ) Notice: Subject to any disclaimer, the term of this patent is extended or adjusted under 35 U.S.C. 154(b) by 780 days.

(21) Appl. No.: 13/378,278

(22) PCT Filed: Jun. 15, 2010

(86) PCT No.: PCT/BR2010/000189

§ 371 (c)(1),
(2), (4) Date: Apr. 9, 2012

(87) PCT Pub. No.: WO2010/144980

PCT Pub. Date: Dec. 23, 2010

(65) Prior Publication Data

US 2012/0240369 A1 Sep. 27, 2012

(30) Foreign Application Priority Data

Jun. 15, 2009 (BR) ..... 0903844

(51) Int. Cl.

| | |
|---|---|
| ***D04H 1/46*** | (2012.01) |
| ***D04H 1/728*** | (2012.01) |
| ***D01D 5/00*** | (2006.01) |
| ***D01F 1/10*** | (2006.01) |

(52) U.S. Cl.

CPC ..... *D04H 1/728* (2013.01); *D01D 5/003* (2013.01); *D01D 5/0069* (2013.01); *D01D 5/0084* (2013.01); *D01F 1/10* (2013.01)

(58) Field of Classification Search

None

See application file for complete search history.

(56) References Cited

U.S. PATENT DOCUMENTS

| | | | | |
|---|---|---|---|---|
| 5,401,458 | A * | 3/1995 | Wadsworth et al. | 264/555 |
| 6,520,425 | B1 * | 2/2003 | Reneker | 239/294 |
| 7,267,789 | B2 * | 9/2007 | Chhabra et al. | 264/115 |

(Continued)

*Primary Examiner* — Monica Huson

(74) *Attorney, Agent, or Firm* — Sughrue Mion, PLLC

(57) ABSTRACT

The present invention refers to an apparatus and method for producing non-woven nanofibers from polymers. The method for producing non-woven micro nanofibers from polymers comprises the use of electrospinning and melt blowing elements. The apparatus presented for producing non-woven micro and/or nanofibers from polymers comprises a source of compressed gas, a pressure gauge, a hypodermic syringe with a pump for controlling the injection rate of the polymeric solutions, a pulverizing apparatus and a collector preferably with controlled rotation speed. The technology presented for producing non-woven micro and/or nanofibers is capable of producing micro and nanofibers having diameters similar to those produced by electrospinning, also on an industrial scale. The invention also comprises the use of non-woven nanofibers in pulverizing live tissues and as coating for materials.

31 Claims, 7 Drawing Sheets

(56) References Cited

U.S. PATENT DOCUMENTS

| | | | | |
|---|---|---|---|---|
| 7,297,305 | B2 * | 11/2007 | Andrady et al. | 264/465 |
| 2003/0137069 | A1 * | 7/2003 | Reneker | 264/29.1 |
| 2007/0018361 | A1 * | 1/2007 | Xu | 264/465 |

* cited by examiner

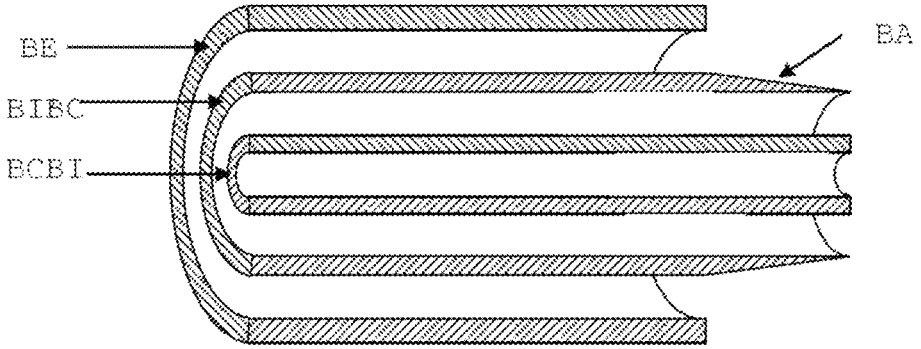
FIGURE. 4
FIGURE. 5A
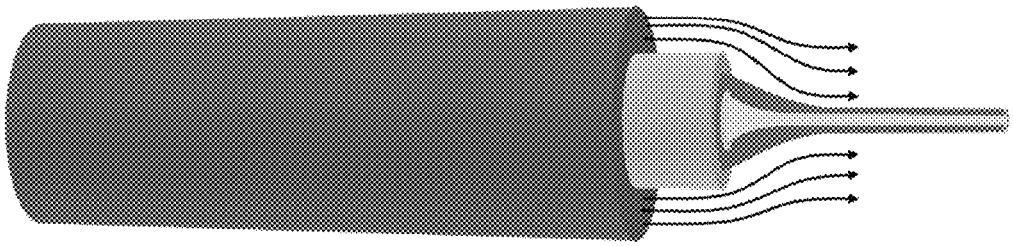
FIGURE. 5B
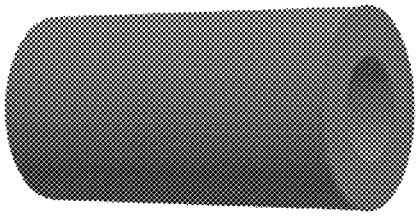
FIGURE. 5C
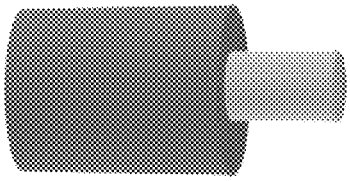

METHOD AND APPARATUS TO PRODUCE MICRO AND/OR NANOFIBER WEBS FROM POLYMERS, USES THEREOF AND COATING METHOD

CROSS REFERENCE TO RELATED APPLICATIONS

This application is a National Stage of International Application No. PCT/BR2010/000189, filed on Jun. 15, 2010, which claims priority from Brazilian Patent Application No. PI 09038442-2,filed on Jun. 15, 2009, the contents of all of which are incorporated herein by reference in their entirety.

FIELD OF THE INVENTION

This invention refers to the production of micro and/or nanofiber webs, particularly to a method and apparatus to produce micro and/or nanofiber webs from polymers. The method for producing micro and/or nanofiber webs from polymers comprises the use of elements from both electrospinning and melt-blow spinning technologies such as compressed gas jets at high speed. Additionally, the present invention refers to the use of the micro and/or nanofiber webs now obtained.

BACKGROUND OF THE INVENTION

The technology of producing nanofibers has drawn special attention due to the unique properties nanofibers have compared to fibers with greater diameters made from the same materials. By decreasing the diameter of the fibers to a nanoscale, it is possible to increase significantly the surface volume with an improvement in the thermal and sound insulation. Furthermore, there is an increase in the liquid retention capacity, and changes occur in the texture and appearance.

The nanofibers can be comprised of various polymers, of synthetic or natural origin, and can be used for medical purposes, such as supports for tissues, controlled release of medicaments, and as curatives for skin regeneration. Important applications for micro and nanofibers have also been identified in non-medicinal products, such as air filters, protective clothing, sensors, electronics and matrices to immobilize catalysts, military applications and in cleaning utensils.

The majority of nanofibers are produced by melt spinning, electrospinning, or by hot air jets at high speed.

Melt spinning technology involves directing threads of the cast polymer to reduce the diameter of the fiber and induce the orientation of the polymeric chains. One of the limitations of melt spinning is that it is restricted to viscoelastic materials, which can withstand the efforts developed during the process. The diameter of the fibers made by this process is normally greater than 2 μm.

A variation of melt spinning for producing nanofibers is the islands-in-the-sea process, in which various individual matrices of a polymeric component are produced inside a single biggest thread of a second polymeric component. The bicomponent fibers are degraded at the same time using specialized equipment. A variation of this process that merely requires twin-screw extrusion equipment uses two immiscible polymers. The main limitation of this technique is the need for solvents to remove the sea component and the limited number of polymeric materials which can be treated in this manner.

A technique conventionally used for producing polymeric nanofibers is electrospinning ("electrospinning"). Electrospinning consists of the application of electrostatic and drag forces in the polymeric solution for forming nanofibers. The process includes an electrode connected to a positive (or negative) high voltage power supply inserted in the polymeric solution contained in a capillary tube. Initially, the solution is kept by its surface tension in the form of a drop at the end of the capillary. With the increase in the electrical voltage, the surface of the drop extends to form a cone (Taylor cone). When the electrostatic forces overcome the surface tension, a jet laden with the solution at the end of the cone is ejected. During the trajectory of the jet, the solvent evaporates and the polymer solidifies, forming a micro and/or nanofibrilar web that is deposited in an earthed metallic collector. Variables may influence the obtention of nanofibers through this process, such as the polymer/solvent concentration, electrical voltage applied in the solution, addition of salt in the solution, power stream (outflow of the solution from the capillary) and working distance (between the end of the capillary and the collector). The technique of electrospinning produces nanofibers with diameters in the range of 40 nm to 2 μm. Although electrospinning is considered the technique with the greatest potential for large scale production, the low efficiency in the production of fibers is still considered its greatest limitation. In the same way, the solvents compatible with electrospinning are limited by its dielectric constant. The process of electrospinning was patented in 1902, by J. F. Cooley (U.S. application Ser. No. 692,631) and W. J. Morton (U.S. application Ser. No. 705,691). Further developments for manufacturing textile yarns were achieved by Anton Formhals as of 1934 (U.S. Pat. Nos. 1,975,504 and 2,349,950).

Solution spinning is one of the oldest methods for producing nanofibers. This process includes wet spinning and dry spinning. In both methods, the viscous polymeric solution passes through fine holes disposed sequentially and the solvent is subsequently removed for producing the fibers, which are subsequently stretched to decrease their diameter and to confer orientation in order to increase their resistance. In dry spinning, the polymeric solution is pushed through a spinneret inside a heated column called spinning tower, in which the polymeric solution is solidified by evaporating the solvent. In wet spinning, a spinneret is placed in a chemical bath in which the polymer is precipitated by dilution or chemical reaction to form the fibers.

Another conventionally used technique for producing polymeric nanofibers is melt blowing. Melt blowing is a process for producing fibers directly from polymers, through the high speed of a gas jet or another suitable force to mitigate the filaments. The process can be controlled for producing fibers with diameters varying from 1 to 50 μm. Carl Freudenberg filed a patent application describing this process in 1965 (U.S. Pat. No. 3,379,811). The high-speed, hot gas process is also described in patents U.S. Pat. Nos. 3,276,944 and 3,650,866, among others. One of the limitations of high speed, hot air jet technology is that it is limited to the use of thermoplastic polymers.

Patent document WO2005033381 describes a method for electrospinning comprised by the steps of forcing the polymeric solution through a spinneret, in a first direction towards a collector situated at a distance from the first spinneret and, simultaneously, blowing the gas through the holes that are concentrically disposed around the spinneret. The method of this document uses electrospinning with gas jet, besides having an electrostatic force between the nozzle and the injector. In the present invention, the process does not use electrospinning or types of force or electrostatic force differential.

Patent documents CN101068956, U.S.2005067732, WO2006071977 and WO2006071976 use electrospinning for producing polymeric nanofibers. In the techniques described in these documents, the gas jet is an auxiliary component. In the present invention, the blowing is the fundamental component.

Patent document WO2005073442 describes an improved electrospinning technology for the continuous production of polymeric nanofibers from electrostatic spinning with the assistance of air injectors that direct and form the nanofibers. Besides using electrospinning, the method and the apparatus presented in this document use electrostatic forces.

Other patent documents that describe electrospinning technologies include, but are not limited to, WO2008062784, U.S.2008122142, WO2005042813, WO2005024101 and JP2008031624.

The contribution of the production of nanofibers to the growth of the fibers market depends on the development of new technologies, especially the development of large scale production processes.

The present invention describes an unprecedented process for gas jet spinning, comprising the use of elements of both electrospinning and high-speed hot gas jet technologies. The nanofibers produced in the present invention present the same diameters the fibers produced by electrospinning.

SUMMARY OF THE INVENTION

The present invention refers to an apparatus and method for producing micro and/or nanofiber webs from polymers, using elements from both electrospinning and melt-blow technologies such as by high-speed compressed gas jets.

An embodiment of the present invention comprises a method for producing micro and/or nanofiber webs based on a solution of polymers by injecting shear air jets, using a pressure gradient/differential and comprising:

- Pump through at least an inner nozzle a polymeric solution, which comprises at least one polymer dissolved in at least one solvent;
- Pass a compressed gas at high speed through an outer nozzle to direct the production of fibers; and
- Collect the spun polymeric fibers in a collector.

Another embodiment involves an apparatus for producing micro and/or nanofiber webs from solutions of polymers, which comprises:

- a source (1) of compressed gas;
- a pressure-regulating device;
- a recipient device with controlled stream;
- a device for controlling (3) the injection rate of the polymeric solutions;
- a pulverizing apparatus (4); and
- a collector (5).

Further, another embodiment of the invention involves the use of micro and/or nanofiber web produced according to the method, also the object of the present embodiment, in the pulverization of materials selected from among the group of: live tissues, in situ, or any other biological and non-biological tissues, or any kinds of materials in any shape, size and chemical constitution, filtering means, membranes in general, sensors, systems of controlled release of drugs or any other substances, production of micro and nanostructured threads/yarns, cleaning utensils, in impermeable/protective clothing against chemical and biological agents, for cell growth support; use in wound dressing for protection against infections, burns, anti-radiation, and also the use in military application such as an anti-radar for military camouflage.

Another preferred embodiment of the present invention refers to a new method for coating products, such as, ceramics, metals, plastics, rubbers, tissues, fibrous and biological products; by means of the use of the micro and/or nanofiber web now obtained.

BRIEF DESCRIPTION OF THE DRAWINGS

FIG. 4 shows an illustrative scheme of the arrangement of the exits of the concentric nozzles.

FIGS. 5A, 5B and 5C schematically illustrate the process of producing fibers using the system composed by three nozzles.

DETAILED DESCRIPTION OF THE INVENTION

Figure 1:
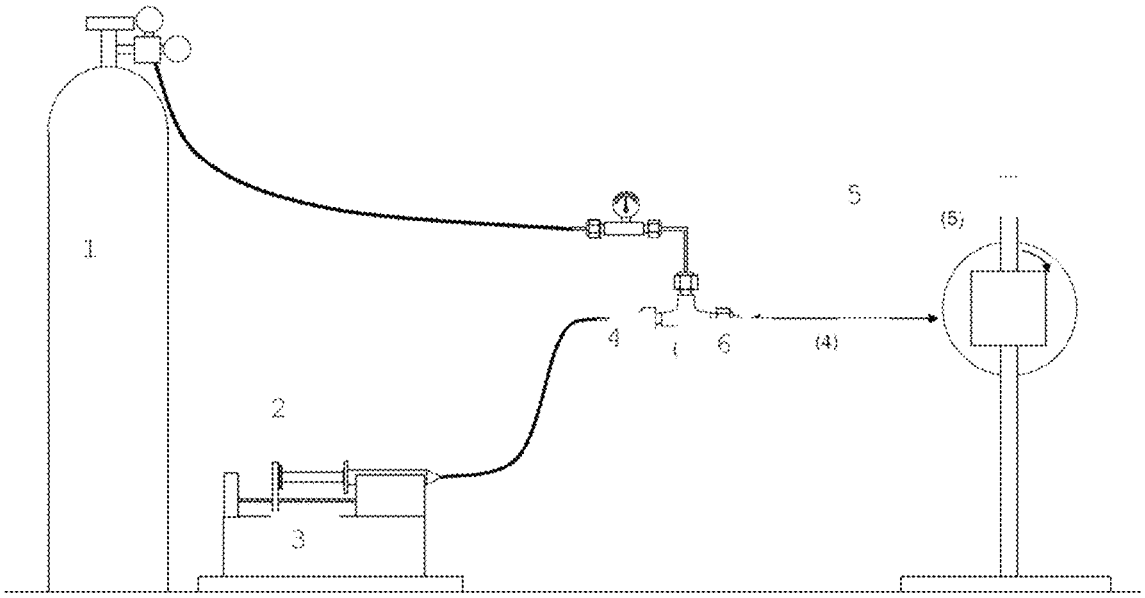
FIG. 1 presents the arrangement of the apparatus for blow spinning.

The present invention refers to an apparatus and a method for producing micro and/or nanofiber webs from a solution of polymers. The method for producing micro and/or nanofiber webs from a solution of polymers comprises the use of electrospinning and melt-blow elements from a polymeric solution (solution blow spinning) with high-speed compressed gas jets.

In order to facilitate the understanding of the technology described, the term gas now used should be understood as a generalization for the use of air jets, oxygen, carbon dioxide, nitrogen, argon, butane and mixtures thereof.

The technology presented for producing micro and/or nanofiber webs is capable of producing nano and microfibers with diameters similar to those produced by electrospinning, also on an industrial scale.

"Nanofibers" are fibers with diameters very much smaller than those of conventional fibers, with diameters lower than 0.5 micron. The most common nanofibers have diameters from 50 to 300 nanometers. Other terms used as synonyms for nanofibers are: micro-denier, submicron and superfine.

"Poly(lactic acid)" or "PLA" is a compostable and biodegradable polyester derived from renewable resources. It is considered a polymer of major technological interest due to its applications in the environmental field, such as biodegradable plastic, and in the biomedical sector, as biocompatible material.

"Polymethylmethacrylate" or "PMMA" is a polymer obtained by polymerization, in suspension in water, of the monomer of methylmethacrylate (methacrylic ester). It has excellent chemical resistance, good mechanical resistance (flexion and traction), excellent surface shine, transparency, is usable to form compositions-blendes with other polymers, has ease of pigmentation, excellent thermal resistance level, surface hardness, low humidity absorption, low post-molding contraction and variety of fluidity levels. The PMMA can be used as implants in surgeries, such as sheets, modeling, extrusion powder, coating resins, emulsion polymers, fibers, paints and films.

"Polyvinyl alcohol" or "PVA" is a water-soluble synthetic resin. PVA has been widely used in fibers, adhesives, emulsifiers, in applications in the textile and paper industries, as colloid protector, for obtaining amphiphilic membranes for immobilizing enzymes and for obtaining poly(vinyl butyral). More recently, PVA has been used as medicine carrier, due to its properties of degradability and non-toxicity. Some applications are designed to alter the permeability to gases, increase the processability and thermal resistance, the capacity to stabilize dispersions, biocompatibility, permeability and biodegradability.

"Polystyrene" or "PS" is a polymer obtained through the polymerization of styrene, in mass or in solution. Polystyrene is a thermoplastic, derived from oil, characterized by its shiny clarity, its hardness, its ease of processing and low cost.

"Polyaniline" or "PAni" is a polymeric cation with selective anion permeability properties, which when in its oxidized state is protoned. It is a conductive polymer that has gained importance due to excellent chemical stability in the doped state (low pH values) in environmental conditions, ease of polymerization and doping, broad electrical conductivity range and low cost, presenting major application possibilities.

The term web as used herein should also be understood as a film, coating, membranes or also as any other term that can be used in this sense.

The melt-blow spinning method of the present invention comprises the use of a device with controlled stream, such as a syringe (2) and is capable of being fed with a polymeric solution. Said device with controlled stream is coupled to a pumping device, that is, a syringe pump (3) which injects the polymeric solution from an apparatus, now also object of the present embodiment, which consists of concentric nozzles through which the polymeric solution is pumped while a constant stream of gas at high speed is injected directing the production of micro and nanofibers.

The process described in the present invention and now schematically shown in FIGS. 5A, 5B and 5C, proves to be a simple method for producing micro and nanofibers webs. The process makes use of the Bernoulli Principle, in which alterations in pressure are converted into kinetic energy, that is, as the high pressure (P1) of the gas stream is let out by the outer nozzle (FIG. 2), the pressure rapidly decreases. Therefore, there a low pressure region (P2) is created due to the geometry of the nozzle (FIG. 2), increasing the kinetic energy of the stream and resulting in an increase of the gas speed, so as to assist with the withdrawal of the polymeric solution from the cone.

This increase in speed generates a drop in pressure in the center of the jet ($P_2$), creating a driving force which is responsible for accelerating the polymeric solution.

The high speed of the gas also provokes the rupture of the gas/solution interface which is responsible for deforming the polymeric solution when emerging from the inside of the outer nozzle in conic form. When the surface tension is overcome by these forces, fine beams of polymeric solution are ejected towards a collector (5), which may or may not be provided with rotation. For the present embodiment, it was preferably used a rotary collector (5) provided with a rotation speed controller. Additionally, said collector (5) comprises virtually any material destined for this purpose, including live biological tissues. During the jet, the solvent evaporates quickly from these beams forming the polymeric fibers which accumulated in the collector (5). For the present invention, said collector (5) can be selected from among the rotary or stationary collector.

In the present invention, the nanofibers are produced by shear air jets which are injected parallely or at an angle of 0° to 80° in relation to the polymer (FIG. 2) and use a pressure gradient/differential.

Figure 2:
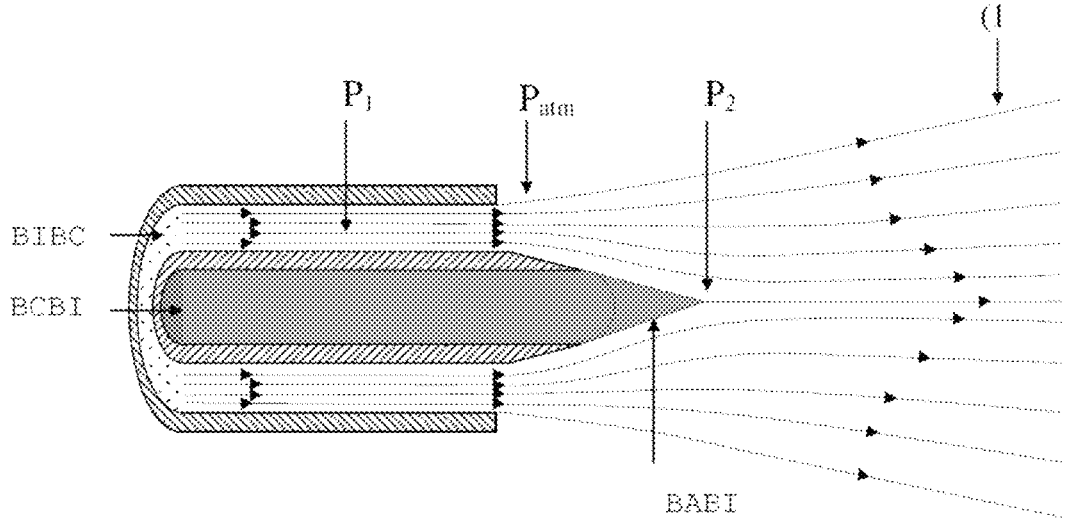
FIG. 2 presents the design of the nozzle used in the polymeric solution spinning.

When there is no gas streaming through the cover of the nozzle, a convex droplet of the polymeric solution is typically formed inside the nozzle, as illustrated in FIG. 2 (dashed line).

When the stream of air in the outer nozzle begins, a low pressure region develops near the hole of the inner nozzle (FIG. 2). The low pressure zone (P2) may also be verified in the syringe pump (3), now referred to as injection pump.

Photomicrographies reveal that webs of polymeric solutions are ejected from the apical region of the cone to the collector (5). FIG. 4 shows the scheme of inflows (E1 and E2) and outflows (S1, S2 and S3) from the pulverizing apparatus (4).

Figure 6:
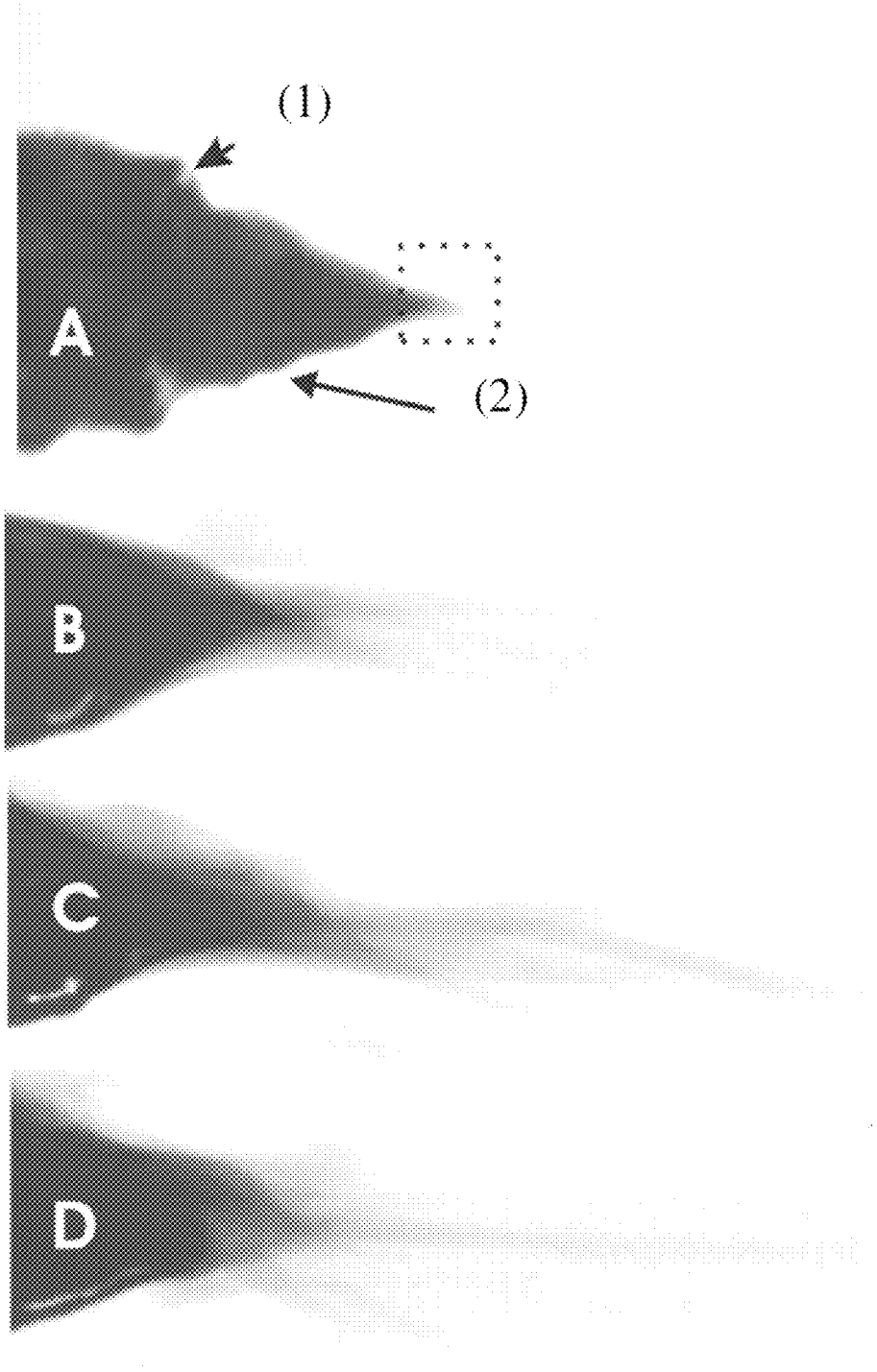
FIG. 6 presents micrographies of solutions of fibers captured through a high-speed camera.

The webs were consistently thrown to the collector (5) due to the combination of the low pressure zone and shearing on the gas/solution interface (FIG. 6). As in electrospinning, the ratio between the volume of the threads coupled with the high air turbulence causes the evaporation of the solvent up to the moment where the fiber reaches the collector (5).

More specifically, in FIG. 6 the picture (A) shows that a low pressure region at the end of the inner nozzle forms the polymeric solution in conic form. Pictures (B), (C) and (D) show the expansion of the region encompassed by dashed lines, where jets of the polymeric solution formed near the cone can be seen streaming towards the collector (5).

Polymers that can be used in this present invention include, but are not limited to, the poly group (lactic acid) (PLA), polymethylmethacrylate (PMMA), polyvinyl alcohol (PVA), polystyrene (PS) and polyaniline (PAni) silk protein, gelatin, collagen, chitosan, polyoxyethylene (PEO), poly(methylmethacrylate) (PMMA), polycaprolactones (PCL), polyamides (PA), polyacrylonitryl (PAN), poly(ethylene terephthalate)(PET), poly(vinyl chloride)(PVC), poly (vinyl pyrrolidone)(PVP), polyurethanes (PU), natural and synthetic rubbers, or also compounds derived therefrom. The technology disclosed by the present invention alternatively allows the use of more than one polymer in blendes or "core/sheath" structures.

The concentration of polymer in the present invention may vary from about 0.1% to about 70%, but this range is not limitative.

To harmonize the terms set forth in the technology developed, the melt-blow spinning technique from the polymeric solution will be referred to as gas jet spinning or simply as gas jet.

The technical solution of gas jet spinning of the present invention has proven extremely useful in medical applications, in which fiber webs can be directly applied to cultures of tissues or a live tissue, in situ, or any other biological and non-biological tissues (FIG. 8) for a variety of medical procedures without applying, for example, high electrical voltage, as in electrospinning. More specifically, in FIG. 8, picture (A) shows pulverization in PLA fiber webs coating the skin of a hand and picture (B) shows the partial removal of the web showing that a coating had been formed over the skin.

Figure 9:
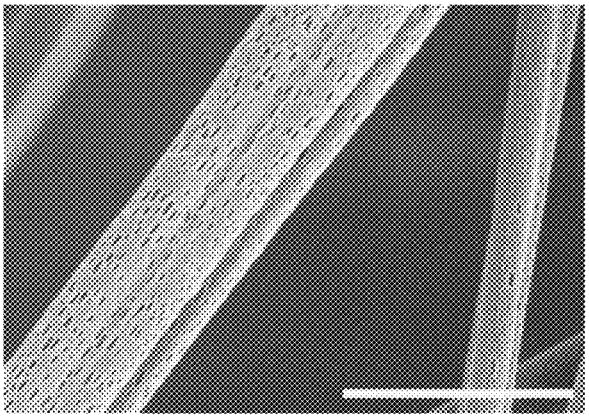
FIG. 9 presents porous fibers produced by the melt-blow spinning technique from a polymeric solution. Scale+5 μm.

Equally, by controlling the relative humidity of the environment around where the fibers are being formed and of the polymeric concentration, it is possible to produce porous fibers with potential for application in the controlled release of drugs (FIG. 9). As in electrospinning, the technique solution of gas jet spinning produces multiples fibers, which generates difficulty in measuring the continuous length of each fiber. However, some fibers isolated from the collector (5) appeared to measure various centimeters in length, and they are likely much bigger, depending on the way in which they are collected. This fact allows the technology developed to be used for producing threads/yarns comprised of lined or unlined nanofibers. Applications for said threads can be in the textile, military and surgical industries, for example.

More specifically, micro and nanostructured webs can be destined for cleaning or personal hygiene, being produced using the micro and/or nanofibers now obtained by the method of the present invention. Additionally, said tissues can be submitted to secondary processes, so as to make them impermeable and usable as filters and membranes in general for chemical and/or biological agents for various applications, such as in individual protection equipment (IPE) and military equipment. For said application, as an example, if a wave-absorbing material (for example, polyaniline), coming from a radar were added to the tissue, it could have applications as an anti-radar barrier to act as camouflage to this kind of radiation. The micro and/or nanofiber webs can also be used in wound dressing for protection against infections and burns.

The jet spinning process presents advantages over other technologies present on the market. The fibers are formed by the action of physical forces, without using forces of an electrostatic nature. It also presents high productivity of fibers (about 10 to 100 times faster), besides providing the possibility of using biological materials in the process. The technology of electrospinning does not permit the use of these materials because it changes their nature, and also kills live cells. The technology disclosed in the present invention also has the advantage of being able to be used for the production of nanofibers in situ in the body, which is not possible with electrospinning technology.

Another relevant factor is that polymers in solvents with low dielectric constant, such as chloroform, are not suitable for the process of electrospinning, but can be used in the process of solution spinning by gas jet of the present invention. Examples of solvents that can be used in the present invention include, but are not limited to, 1,1,1,3,3,3-hexafluoro-2-propanol (HFP), toluene, chloroform, 2,2,2-trifluoroethanol (TFE), acetone, water, acetic acid, formic acid, alcohols, dimethylformamide (DMF), tetrahydrofuran (THF), hexafluoroacetone, hexafluoroisopropyl alcohol, dimethylformamide (DMF), dimethylacetamide (DMAc), methyl ethyl ketone (MEK), dimethyl sulfoxide (DMSO), cyclohexane, etc.

Additionally, the polymers in solution can be laden with organic and inorganic particles such as nanofibers made of carbon, cellulose, $ZrCO_2$, ZnO, CuO, $NiO_2$, $Mn_3O_4$, etc.

An advantage of the method for producing micro and/or nanofiber webs now object of the present invention, consists of the fact that the solvent does not necessarily need a high dielectric constant, since solvents with low and intermediary dielectric constants are perfectly acceptable for said method.

Another preferred embodiment of the present invention refers to a new method for coating products made of different types of materials, such as, ceramics, metals, plastics, rubbers, tissues, fibrous and biological products, by means of the micro and/or nanofiber web now obtained. Said coating allows the preservation of the coated materials, or the production of new properties of the coated materials, or the production of new surface properties such as: increased impermeability, increased adhesiveness, increase in the barrier properties, production of anti-adherent surface among others.

The present invention also provides an apparatus (FIG. 1) for producing nanofiber webs from polymeric solutions, which comprises a source (1) of compressed gas, such as nitrogen, argon and air, a pressure-regulating device, not shown in the drawings accompanying the present specification, a recipient device that allows the feeding of the polymeric solution with controlled stream, such as a hypodermic syringe (2), a device for controlling (3) the injection rate of the polymeric solutions, such as a hypodermic syringe pump, a pulverizing apparatus (4) and a collector (5) with controlled rotation speed.

Figure 3:
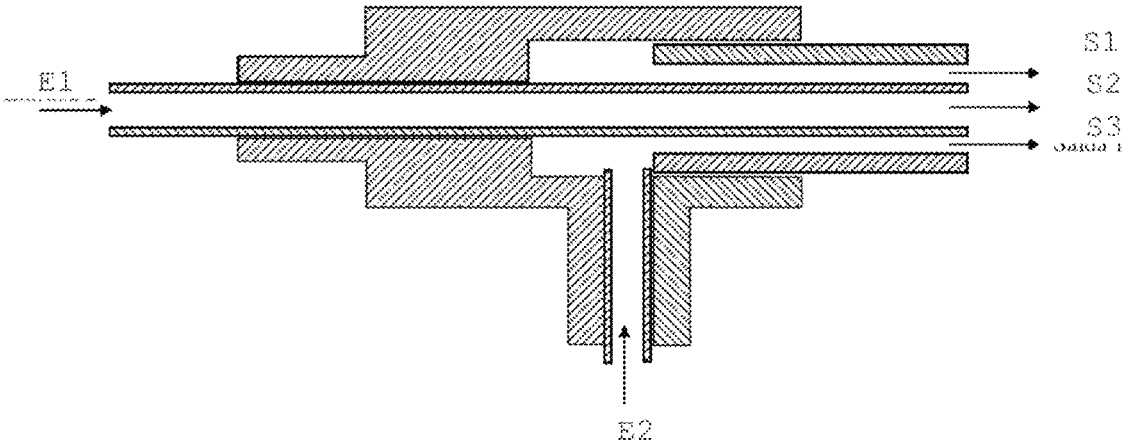
FIG. 3 shows an illustrative scheme of the arrangement formed by the concentric nozzles.

As shown in FIG. 3, said pulverizing apparatus is shown in detail and comprises: inflow (a) and outflow (b) of the solutions; a first nozzle (BE), outer nozzle; a second nozzle (BI), the inner nozzle; a third nozzle (BC), the nozzle located at the center.

More specifically, the apparatus consists of a nozzle from which the polymeric solution is injected into an accelerated gas stream. The arrangement consists of a source of compressed gas (1), equipped with a pressure gauge, a hypodermic syringe (2) preferably 5 ml, a syringe pump (3) (KD Scientific, USA) to control the injection rate (β) of the polymeric solution, a pulverizing apparatus (4) which consists of concentric nozzles and um collector (5), preferably, said collector should have controlled rotation speed (FIG. 1). The collector (5) is preferably positioned at a fixed distance (6) from the nozzle. The concentric nozzles consist of a structural modification of the nozzles such that they can be used to produce fibers composed of more than one kind of material (core/sheath structure). More specifically, said nozzles consist of a system of 3 (three) concentric nozzles, as shown in FIG. 2 and specified below:

- a first nozzle (BE) located more externally from where the gas (air/fluid) is released for spinning;
- a second nozzle (BI) located more internally from where the polymeric solution forming the center (core) of the fibers is released; and
- a third nozzle (BC) located at the center, called intermediary, from where the polymer forming the sheath of the fibers exits.

More particularly, the second nozzle is provided with a thinner end, which facilitates the stream of gas without disruptions in the system, which increases the shearing and decreases the turbulence of the gas at the exit.

The operating process of the pulverizing apparatus (4) is developed such that the polymeric solution is pumped through at least an inner nozzle (BI) under a discharging pressure in the range of about 1 to 1000 kPa and at a pumping rate varying in the range of about 1 to 1000 μL/min, preferably varying in the range of 20 to 200 μL/min and the high speed gas (pressurized) traverses the at least one concentric outer nozzle (BE), that is by means of the first concentric nozzle (BE) through where a high pressure current (P1)(FIG. 2) passes. The pressure of the pressurized gas (p) may vary in the range between 60 and 520 kPa.

However, any person skilled in the art would understand that this pressure range can be higher and/or lower, depending on the concentration of the polymeric solutions, of the molar mass of the polymers, of the kind polymer involved, and the opening between the nozzles of the concentric nozzles system.

The technology presented for producing nanofiber webs through jet spinning produces micro and nanofibers with diameters similar to those produced by electrospinning and has great potential for industrial scale production.

Additionally, the pressurized gas now used in the method and in the apparatus now objects of the present embodiment, may alternatively be submitted to a heating system so as to facilitate the steps of the procedure used in the melt-blow spinning technique for producing micro and nanofibers when using low-volatility solvents.

Said heating system comprises, at least, an electrical resistance and a passage duct of heated fluid. However, said heating system is not limited to this arrangement now described. It may be provided with any other system capable of heating the gas used in the melt-blow spinning process.

As mentioned previously, depending on the diameter of these fibers, it is possible to broaden the range of applications. For example, when porous micro and nanofibers are formed, they can be used in filters and other separation processes, besides catalytic processes and sensors. The nucleus of the fiber can be laden with a drug (medicine) and these fibers used for the controlled release of this drug.

EXAMPLE

Materials:

Samples of polymers polyvinyl alcohol, PVA, (97% hydrolyzed, Mw=5-8×$10^4$g/mol) polymethylmethacrylate, PMMA, (Mw=1.2×$10^5$g/mol), and polystyrene, OS, (Mw=1.9×$10^5$g/mol) were acquired from Sigma-Aldrich (St. Louis, Mo., USA). Poly(lactic acid). PLA, (Polylactide resin 4042D, Mw=6.6×$10^4$g/mol) was acquired from NatureWorks LLC (Minnetonka, Minn., USA). Polyaniline, PAni, was chemically synthesized according to the methodology described in literature (Mattoso L. H. C., MacDiarmid, A. G. In Polymeric Materials Encyclopedia Edited by J. C. Salamone, CRC Press, Boca Raton, (1996), pp. 5505-5513; MacDiarmid, A. G., Epstein, A. J. Farad Disc Chem Soc, (1989), pp. 88 to 317).

The solvents used included 1,1,1,3,3,3-hexafluoro-2-propanol (HFP) and toluene which were acquired from Sigma-Aldrich (St. Louis, Mo., USA) and 2,2,2-trifluoroethanol (TFE) which was acquired from Alfa Aesar (Ward Hill, Mass., USA).

Methods:

Apparatus for solution spinning by gas jet (solution blow spinning): The melt-blow spinning apparatus used in the present invention consists of a nozzle through which the polymeric solution is injected into/pumped into an accelerated gas stream. The structure consisted of a source of compressed gas, equipped with a pressure gauge, a hypodermic syringe preferably 5 ml, a syringe pump (KD Scientific, USA) to control the injection rate (β) of the polymeric solutions, a pulverizing apparatus which consisted of concentric nozzles, and a collector with controllable rotation speed (FIG. 1). The collector was positioned at a fixed working distance from the nozzle. Alternatively, the working distance can be mobile during the formation of the fibers, if it is desirable to obtain a non-woven web with mixed characteristics. The pulverizing apparatus generally consisted of an inner nozzle and an outer concentric nozzle (FIG. 2). The polymeric solution was pumped through the inner nozzle and a high speed gas (pressurized) passed through the concentric outer nozzle (FIG. 2).

Experiments: A series of experiments was carried out by diverse parameters of processes using the polymeric solution consisting of 10% of PMMA in chloroform. Variables were tested to determine its effect on the thickness and morphology of the fiber. Processes in standard conditions included an injection rate (β) of 20 μl/min, gas pressure (nitrogen)(p) of 276 kPa, working distance of 20 cm, a distance (d) of 2 mm in which the inner nozzle is behind the outside, and a polymer concentration of (c) of 10%. The effect of individual variables was studied using standard conditions and just changing a single variable at a time. The level of each variable tested is indicated in Table 1 below. The diameters of the fibers were measured by a minimum of 50 fibers for each variable tested. The morphology of the fiber was determined by SEM micrographies. Solutions (10%) of PLA and PS in TFE and toluene, respectively, were also prepared to demonstrate the technique of solution spinning by gas jet with a variety of polymeric solutions.

TABLE 1

Effect of treatment of variable data in the diameter of PMMA fibers made by the solution spinning gas jet technique. The variables include injection rate (β), air pressure supplied by the outer nozzle (p), working distance ((WD), see FIG. 1), distance from the inner nozzle (D), and polymer concentration (c).

| | β (μL/min) | | | | | | |
|---|---|---|---|---|---|---|---|
| | 5 | 10 | 20 | 40 | 60 | 80 | 100 |
| Fiber Diam. (μm) (standard) | 1.22 (0.58) | 1.77 (1.46) | 2.26 (1.24) | 1.39 (0.66) | 1.41 (0.96) | 1.52 (0.94) | 1.01 (0.46) |

| | p (kPa) | | | | |
|---|---|---|---|---|---|
| | 69.0 | 138 | 276 | 414 | 517 |
| Fiber Diam. (μm) (standard) | 1.32 (0.72) | 2.01 (1.13) | 2.26 (1.24) | 1.59 (0.83) | 0.84 (0.43) |

TABLE 1-continued

Effect of treatment of variable data in the diameter of PMMA fibers made by the solution spinning gas jet technique. The variables include injection rate (β), air pressure supplied by the outer nozzle (p), working distance ((WD), see FIG. 1), distance from the inner nozzle (D), and polymer concentration (c).

| | WD (cm) | | | |
|---|---|---|---|---|
| | 7.2 | 12.5 | 17 | 25 |
| Fiber Diam. (μm) (standard) | 1.57 (0.73) | 2.57 (0.87) | 2.76 (1.64) | 2.48 (1.48) |

| | D (mm) | | | | | |
|---|---|---|---|---|---|---|
| | 0 | 1 | 2 | 2.6 | 3 | 3.5 |
| Fiber Diam. (μm) (standard) | 3.46 (1.53) | 2.43 (1.26) | 3.85 (2.40) | 2.98 (1.33) | 3.04 (1.42) | 3.37 (1.52) |

| | c (%) | | |
|---|---|---|---|
| | 5 | 10 | 15 |
| Fiber Diam. (μm) (standard) | 0.87 (0.39) | 3.05 (1.71) | 5.19 (2.54) |

Electrospinning: An electrospinning apparatus was created and the conditions were optimized as previously described (Medeiros, E. S., Mattoso, L. H. C., Offeman, R. D., Wood, D. F, Orts, W. J. Can. J. Chem., 86 (06), 2008, pp. 590-599; Medeiros, E. S., Mattoso, L. H. C., Ito, E. N., Gregorski, K. S., Robertson, G. H., Offeman R. D., Wood, D. F., Orts, W. J., Imam, S. H. J. Biobased Mat. Bioenergy, 2 (3), 2008, pp. 231-242). The electrospinning and solution spinning gas jet techniques were compared by producing fibers of both techniques using the same polymeric solutions. The experiment conditions used for the electrospinning of each system polymer/solvent system are listed in Table 2 below. In each experiment, the polymer concentration (10%, w/v), the working distance (20 cm), and the rotation speed of the collector (800 rpm) were kept constant.

TABLE 2

Experiment conditions used for producing electrofibers and fibers by solution spinning by gas jet.

| | Electrospinning | | Solution Spinning | |
|---|---|---|---|---|
| Polymer/solvent | V (kV) | β (μL/min) | p (kPa) | β (μL/min) |
| PS/Toluene | 0 | 6.0 | 76 | 20 |
| PLA/TFE | 1 | 5.0 | 76 | 20 |
| PLA:PAni (96:04 wt %)/HFP | 0 | 6.0 | 76 | 20 |
| PMMA/Chloroform | 1 | 5.0 | 76 | 20 |

Pictures of the fibers obtained by the solution spinning by gas jet technique: Fibers of polymeric solution which were ejected from an inner nozzle were photographed with a camera with rolling shutter (Model SI1280M-CL, Silicon Imagin, Inc., Costa Mesa, Calif., USA) at 450 frames per second. The camera was mounted on a stereomicroscope (Model MZ 16 F, Leica Microsystems Ltd, Heerbrugg, Switzerland) focused on the end of the inner nozzle. A white background and a fiber optics light source (Model MC500, Schott Instruments GmbH, Mainz, Germany) provided high contrast in the picture. The polyaniline (PAni) was mixed with PLA (4:96% weight) in HFP to improve the contrast of the image, making it darker and more opaque against the white background.

Scanning electronic microscope (SEM): The samples were spun to rotary collector and collected for SEM analysis. Samples for SEM were covered with gold for 45 s and the morphology of the fibers was analyzed using a Hitachi Scanning Electronic Microscope (Model S4700, Hitachi High-Technologies, Japan) operated at a voltage of 2 kV. The thickness of the fiber was measured in SEM images using specialized software (MeasureIT, version 5.0, Olympus Soft Imaging Solutions, GmbH).

Figure 7:
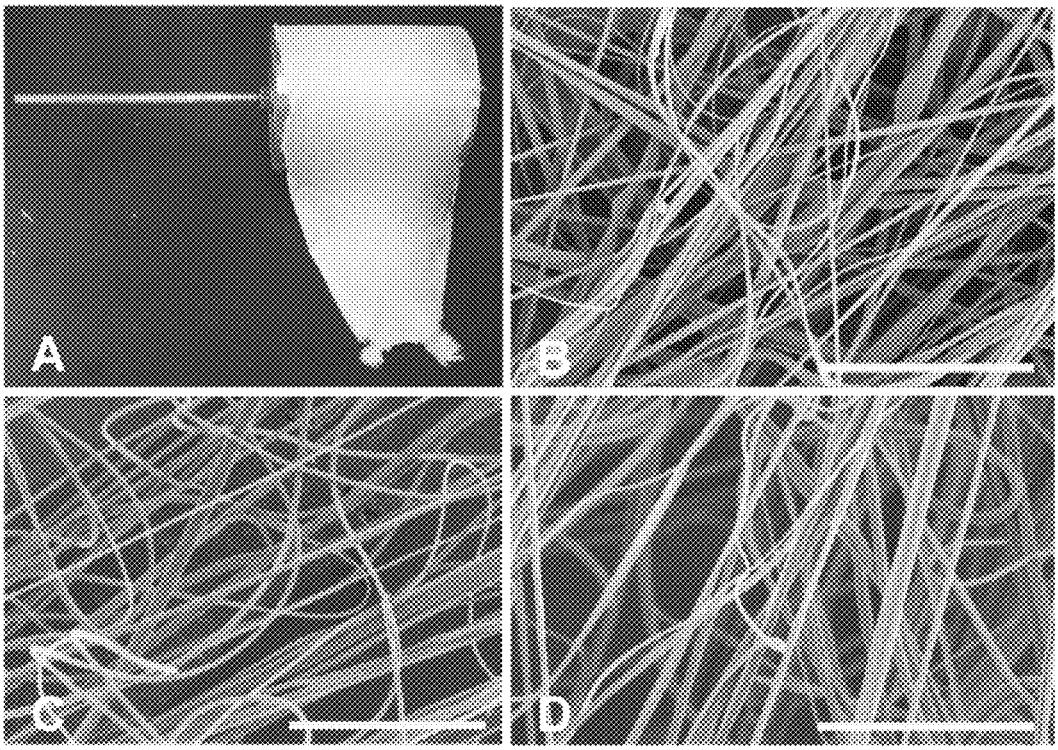
FIG. 7 presents spun polymeric fibers collected from a rotary cylindrical collector also used to collect electrospun fibers.
Figure 8:
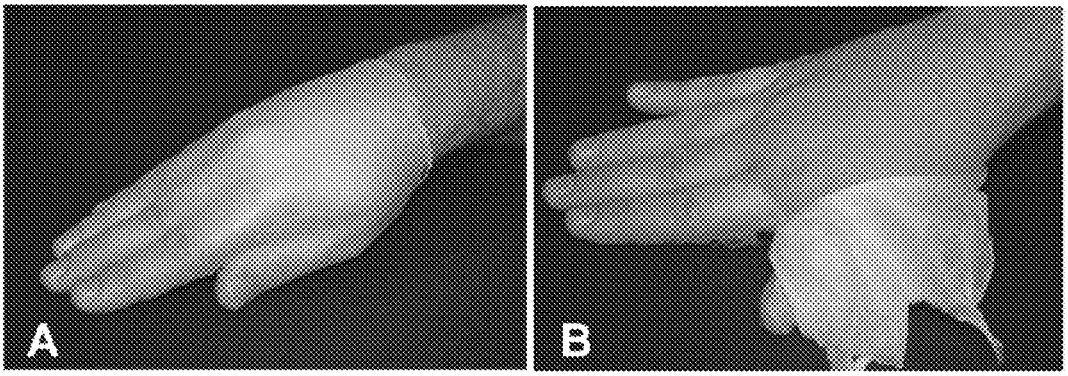
FIG. 8 presents photographs showing the feasibility of pulverizing fibers directly on live tissues.
Figure 10:
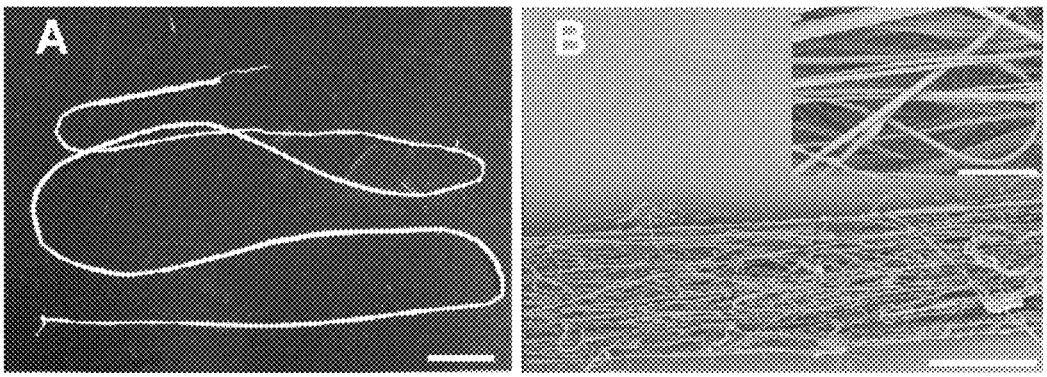
FIG. 10 presents threads of the fibers produced.

Results: The process described in the present invention proved to be a simple method for producing micro and nanofiber webs. The process made use of the Bernoulli Principle in which alterations in pressure are converted into kinetic energy, that is to say, as the high pressure from the gas stream exits the outer nozzle (FIG. 2, $P_1$), the pressure falls rapidly (FIG. 2, $P_{atm}$), increasing the kinetic energy of the stream and resulting in an increased in the speed of the gas. This increase in speed caused a drop in pressure at the center of the jet ($P_2$), creating a driving force which is responsible for accelerating the polymeric solution. The high speed of the gas also caused the rupture of the gas/solution interface which is responsible for deforming the polymeric solution when leaving from inside the nozzle in conic form. When the surface tension was overcome by these forces, fine beams of the polymeric solution were ejected towards the collector. During the jet, the solvent quickly evaporated from these beams forming the polymeric fibers which accumulated in the collector. When there was no gas streaming through the cover of the nozzle, a convex drop of the polymeric solution was formed inside the nozzle, as illustrated in FIG. 2 (dashed line). When the stream of air in the outer nozzle began, a low pressure region developed near the hole of the inner nozzle (FIG. 2, $P_2$). The low pressure zone could also be verified in the injection pump. Photomicrographies revealed that webs of polymeric solutions were ejected from the apical region of the cone to the collector. The webs were consistently thrown to the collector due to the combination of the low pressure zone and to the cut in the gas/solution interface (FIG. 6B-D). As in electrospinning, the ratio between the volume of the threads coupled with the high turbulence of the gas caused the evaporation of the solvent up to the moment the fiber reaches the collector. Fiber made from polymeric solutions of PMMA, PS, PLA and PLA/PAni using standard conditions mentioned above were promptly formed in non-woven membranes (FIG. 7) using a rotary collector as shown in FIG. 1. In FIG. 7, picture (A) shows a photograph of a mass of fibrous webs deposited in a rotary cylindrical collector. Picture (B) shows images of scanning electronic microscope (SEM) of the fiber of polymethylmethacrylate (PMMA), picture (C) of polystyrene (PS) and picture (D) of poly (lactic acid) (PLA). It is also possible to note the partial alignment of fibers as a consequence of a directed rotation during spinning. The pictures are in the scale of: (B) 50 μm and (C) and (D) 5 μm. Non-woven webs, that is, the webs were also collected easily and safely in a variety of objectives, including live tissues (FIG. 8). The technique of solution spinning by gas jet proves to be extremely useful among other applications, in medical applications where webs can be applied directly to tissues or cultures of live tissues for a variety of medical procedures without applying, for example, high electrical voltage, such as in electrospinning. By controlling the relative humidity of the environments where the fibers are being formed and the polymer is concentrated, it is possible to produce porous fibers with a potential for application in the controlled release of drugs/medicines (FIG. 9). As in electrospinning, the technique of solution spinning by gas jet generates multiple twists of threads, which made it difficult to measure the continuous length of each fiber. However, some fibers isolated from the collector appeared to be various centimeters in length, and it, is possible that some fibers could be much greater, depending on how they were collected. For example, continuous threads of various centimeters in length were made by positioning a barrier (for example, a thread) in front of the nozzle of the apparatus to capture the fibers which streamed from the nozzle to the collector (FIG. 10). For said figure, picture (A) shows threads of PMMA being various centimeters in length whereas picture (B) shows SEM micrographies of threads showing that they are composed of long fibers with diameters varying from 700 nm to 2μm. The scale of the picture (A) is 1 cm and 200 μm for picture (B) (inserting 20 μm). A direct comparison was made between pairs of polymeric solutions which could be both electrospun and spun by solution (which has fewer relative limitations). The diameters of the solution and electrospun and fibers made from 10% of PMMA, PLA, PS and mixtures of PLA/PAni were similar (Table 3).

TABLE 3

Comparison of diameters of fibers spun by solution and electrospun micro and nanofibers using four different polymeric solutions

| | Fiber diameter (nm) | |
|---|---|---|
| Polymer/solvent | Solution spinning | Electrospinning |
| PLA/TFE | 80-260 | 90-220 |
| PLA:PAni/HFP | 140-590 | 130-800 |
| PS/Toluene | 220-4.400 | 200-1.800 |
| PMMA/Chloroform | 1.000-7.800 | 1.000-5.000 |

The diameter of the fibers produced by gas jet spinning of solutions containing PMMA were also comparable to the diameters of electrospun fibers of PMMA. Spun fibers of PMMA solutions had diameters in the range of 1 and 7.8 μm using standard conditions. Fibers with diameters as small as 160 nm were produced for the same polymer concentration when formed at 517 kPa. Although the injection rate standard used for the gas jet solution spinning is 20 μL/min, injection rates of up to 200 μL/min were successfully tested. For comparison purposes, the injection rate typically used for electrospinning is just 4-10 μL/min, about more than one order of magnitude lower than that obtained for the technique of solution spinning by gas jet. The variations in the parameters affected the diameter of the fibers, the morphology, and the ease of transformation, although the injection rate had no pronounced effect on the average diameter of the fibers (Table 1). However, injections rates of about 60 μL/min and above resulted in fibers that were more consistent in thickness and much higher fiber production rates. Injection rates below 20 did not have sufficient supply of polymeric solution for the nozzle and merely caused an intermittent stream in the nozzle.

Figure 11:
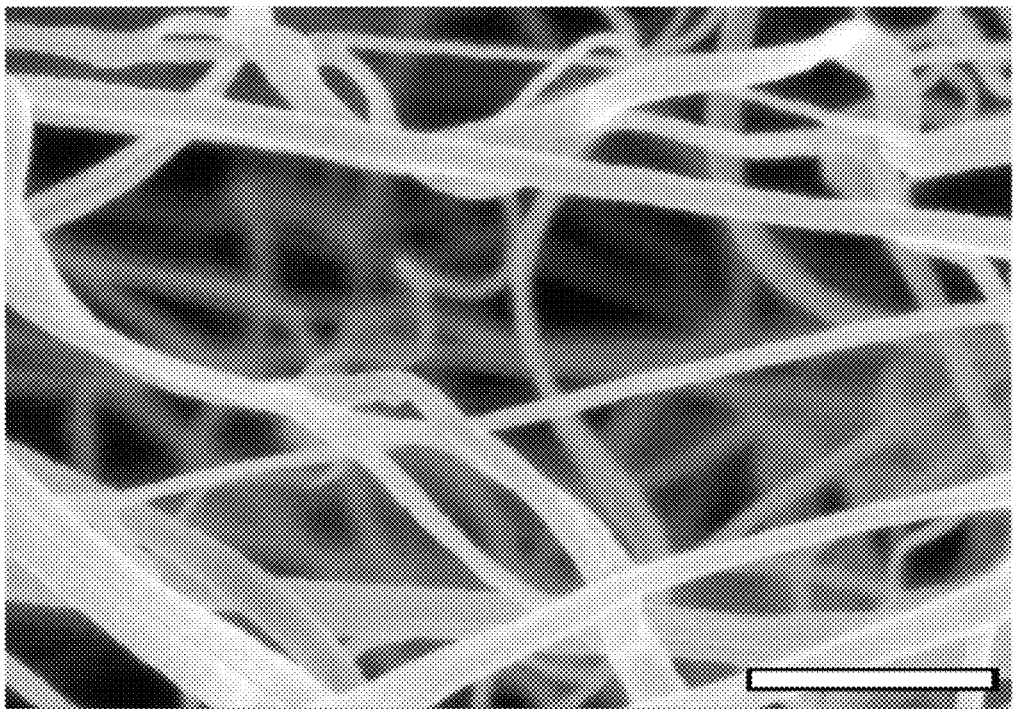
FIG. 11 presents a SEM micrography of PLA nanofibers of about 40 nm in diameter. Scale=500 nm.

The gas pressure (p) had a relatively minor effect, but significant on the diameter of the fiber. When air pressure arrangements were very low, the fiber lost speed and often did not have the necessary force to reach the target. The diameter of the fiber increased with the increase in the gas pressure from 69 to 276 kPa but afterwards it falls to superior pressures. Fibers with lesser diameters were produced in the highest pressures tested (Table 1). As in electrospinning, there must be a balance between the gas pressure and the polymer injection rate so as to produce uniform and fine fibers by the technique of solution spinning by gas jet. Increasing the gas pressure may lead to the formation of fibers with irregular diameters as well as spherical particles connected to the fibers (beads). However, by keeping the pressure constant and adapting the injection rate higher, the gas stream and the injection rate become balanced and uniform, with smooth fibers and without spheres. The working distance (WD) did not have a significant effect on the diameter of the fiber (Table 1). However, this parameter was important in the morphology of the fiber. When the WD was too short, the fibers did not have sufficient opportunity to dry completely before reaching the collector and simply adhered to other fibers, or, in extreme cases, collided immediately with other fibers in the film. The distance (d) from the inner nozzle to the outer nozzle (or protuberance) had little effect on the diameter of the fiber. However, the process was affected by d; when d was zero or above 3 mm, residues of the polymeric solution were formed around the nozzle on its insides. The accumulation of residues meant that the process had to be interrupted momentarily to remove the residues at periodic intervals. The concentration of the polymer in the solution had a significant effect on the diameter of the fiber. The increase in polymer concentration increased the diameter of the fiber and, inversely, fibers with smaller diameters were obtained when lower polymer concentrations were used. For example, when 5% of poly(lactic acid) in TFE solution was spun (FIG. 11), using normal conditions, fibers with diameters of up to 40 nm were produced.

The invention claimed is:

1. A method for producing micro and/or nanofiber webs from a solution of polymers, characterized by the injection of shear air jets, using a pressure gradient/differential and comprising:

pumping through two or more inner nozzles one or more polymeric solutions, each comprising at least one polymer dissolved in at least one solvent, wherein a polymeric solution pumped through one inner nozzle may be the same as or different from a polymeric solution pumped through another inner nozzle;

passing a compressed gas at high speed through an outer nozzle to direct the production of fibers; and collecting the polymeric fibers spun in a collector, wherein the inner and outer nozzles are concentric, the two or more inner nozzles extend beyond the outer nozzle in the direction in which the one or more polymer solutions are ejected, one of the two or more inner nozzles is the innermost nozzle, and an electrostatic force differential is not applied between the nozzles and the collector.

2. The method for producing micro and/or nanofiber webs according to claim 1, characterized in that the shear air jets are injected parallely or at an angle in relation to the polymer.

3. The method for producing micro and/or nanofiber webs according to claim 1, characterized in that the polymers are selected from the group consisting of poly (lactic acid), polymethylmethacrylate, polyvinyl alcohol, polystyrene and polyaniline, silk protein, gelatin, collagen, chitosan, polyoxyethylene (PEO), poly(methylmethacrylate) (PMMA), polycaprolactones (PCL), polyamides (PA), polyacrilonitryl (PAN), poly(ethylene terephthalate) (PET), poly(vinyl chloride)(PVC), poly(vinyl pyrrolidone) (PVP), polyurethanes (PU), natural and synthetic rubbers, and compounds derived therefrom.

4. The method for producing micro and/or nanofiber webs according to claim 1, wherein the at least one polymer is a polymer blend.

5. The method for producing micro and/or nanofiber webs according to claim 4, wherein the at least one polymer has a "core/sheath" structure.

6. The method for producing micro and/or nanofiber webs according to claim 1, characterized in that the concentration of the polymer is from about 0.1% to about 70%.

7. The method for producing micro and/or nanofiber webs according to claim 1, characterized in that the solvent has a dielectric constant varying between low, intermediary and high.

8. The method for producing micro and/or nanofiber webs according to claim 7, characterized in that the solvent has a low dielectric constant.

9. The method for producing micro and/or nanofiber webs according to claim 7, characterized in that the solvent has an intermediary dielectric constant.

10. The method for producing micro and/or nanofiber webs according to claim 1, characterized in that the solvent is selected from the group consisting of 1,1,1,3,3,3-hexafluoro-2-propanol (HFP), toluene, chloroform, 2,2,2-trifluoroethanol (TFE), acetone, water, acetic acid, formic acid, alcohols, dimethylformamide (DMF), tetrahydrofuran (THF), hexafluoroacetone, hexafluoroisopropyl alcohol, dimethylformamide (DMF), dimethylacetamide (DMAc), methyl ethyl ketone (MEK), dimethyl sulfoxide (DMSO), and cyclohexane.

11. The method for producing micro and/or nanofiber webs according to claim 1, characterized in that the polymers in solution are laden with organic or inorganic particles.

12. The method for producing micro and/or nanofiber webs according to claim 1, characterized in that the compressed gas is selected from the group consisting of air, nitrogen, argon and oxygen, carbon dioxide, butane and mixtures thereof.

13. The method for producing micro and/or nanofiber webs according to claim 1, characterized in that the polymeric solution is discharged by compression through the inner nozzle under a discharging pressure in the range of about 1 to 1000 kPa and pumping rate varying in the range of 1 to 1000 μL/min.

14. The method for producing micro and/or nanofiber webs according to claim 12, characterized in that the pressure of the pressurized gas (p) varies in the range of between 60 and 520 kPa and the pumping rate of the polymeric solution varies from about 20 to about 200 μ/min.

15. The method for producing micro and/or nanofiber webs according to claim 1, characterized in that the pressurized gas is submitted to a heating system.

16. The method for producing micro and/or nanofiber webs according to claim 15, characterized in that the heating system comprises at least an electrical resistance and a passage duct of heated fluid.

17. The method for producing micro and/or nanofiber webs according to claim 15, characterized in that the heating system comprises a system capable of heating the gas used in the melt-blow spinning process.

18. A method for producing micro and/or nanofiber webs according to claim 11, wherein the organic or inorganic particles are nanofibers made from carbon, cellulose, $ZrCO_2$, ZnO, CuO, $NiO_2$, or $Mn_3O_4$.

19. The method for producing micro and/or nanofiber webs according to claim 1, characterized in that the two or more inner nozzles are arranged such that the passing of the compressed gas at a high speed through the outer nozzle develops a low pressure region at a location where the one or more polymer solutions exit the two or more inner nozzles.

20. The method for producing micro and/or nanofiber webs according to claim 1, comprising the step of ejecting the polymer solutions from the two or more inner nozzles using a low pressure region formed by the passing of the compressed gas at a high speed through the outer nozzle.

21. The method for producing micro and/or nanofiber webs according to claim 1, further comprising the step of controlling the diameter of the fibers by controlling a gas pressure of the compressed gas.

22. The method for producing micro and/or nanofiber webs according to claim 21, comprising the step of creating fibers of increased diameter by setting the gas pressure from 69 to 276 kPa.

23. The method for producing micro and/or nanofiber webs according to claim 21, comprising the step of creating fibers of decreased diameter by setting the gas pressure above 276 kPa.

24. A method for coating products characterized in that it occurs by means of the use of micro and/or nanofiber web as obtained by claim 1.

25. An apparatus for producing micro and/or nanofiber webs from solutions of polymers pursuant to the method in claim 1, characterized by comprising:

a source (1) of compressed gas;

a pressure-regulating device;

a recipient device with controlled stream;

a device for controlling (3) the injection rate of the polymeric solutions;

a pulverizing apparatus (4) comprising concentric nozzles; and a collector (5);

wherein the concentric nozzles comprise the two or more inner nozzles and the outer nozzle, wherein:

the outer nozzle ejects a gas (air/fluid) for electrospinning;

the first inner nozzle is located more internally and ejects a polymer solution;

the second inner nozzle is located at the center and ejects a polymer solution;

the two or more inner nozzles extend beyond the outer nozzle in the direction in which the one or more polymer solutions are ejected; and the apparatus does not include a portion configured to apply an electrostatic force differential between the nozzles and the collector.

26. An apparatus for producing micro and/or nanofiber webs according to claim 25, characterized in that the first inner nozzle is provided with a thinner end.

27. An apparatus for producing micro and/or nanofiber webs according to claim 25, characterized in that the collector is selected between rotary or stationary collector.

28. An apparatus for producing micro and/or nanofiber webs according to claim 27, characterized in that the collector selected is rotary.

29. An apparatus for producing micro and/or nanofiber webs according to claim 28, characterized by having a control rotation speed and being positioned preferably at a fixed working distance (6) from the outer nozzle.

30. An apparatus for producing micro and/or nanofiber webs according to claim 28, characterized in that alternatively the collector is located at a mobile working distance during the formation of the fibers.

31. An apparatus for producing micro and/or nanofiber webs according to claim 25, characterized in that the two or more inner nozzles are arranged such that the passing of the compressed gas at a high speed through the outer nozzle develops a low pressure region at a location where the one or more polymer solutions exit the two or more inner nozzles.

* * * * *